US008971779B2

(12) United States Patent
Yoshinaga et al.

(10) Patent No.: US 8,971,779 B2
(45) Date of Patent: Mar. 3, 2015

(54) FIXING DEVICE WITH SUPPORT AND IMAGE FORMING APPARATUS INCORPORATING SAME

(71) Applicants: Hiroshi Yoshinaga, Chiba (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(72) Inventors: Hiroshi Yoshinaga, Chiba (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

(21) Appl. No.: 13/690,882

(22) Filed: Nov. 30, 2012

(65) Prior Publication Data

US 2013/0170879 A1 Jul. 4, 2013

(30) Foreign Application Priority Data

Dec. 28, 2011 (JP) ..... 2011-289277

(51) Int. Cl.
*G03G 15/20* (2006.01)

(52) U.S. Cl.
CPC ..... *G03G 15/2067* (2013.01); *G03G 15/2053* (2013.01)
USPC ..... 399/329; 399/328

(58) Field of Classification Search
CPC combination set(s) only.
See application file for complete search history.

(56) References Cited

U.S. PATENT DOCUMENTS 6,993,279 B2 * 1/2006 Fukuzawa et al. ..... 399/329
8,559,861 B2 * 10/2013 Lee et al. ..... 399/329

(Continued)

FOREIGN PATENT DOCUMENTS

JP 07-191561 A 7/1995
JP 2004-062053 2/2004

(Continued)

OTHER PUBLICATIONS

U.S. Appl. No. 13/557,841, filed Jul. 25, 2012, Toshihiko Shimokawa, et al.

(Continued)

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

A fixing device includes a support supporting a nip formation assembly that presses against an opposed rotary body via an endless belt to form a fixing nip between the endless belt and the opposed rotary body. The support includes a base contacting the nip formation assembly. An upstream projection projects from the base in a pressurization direction of the opposed rotary body at a position on the base corresponding to or upstream from an upstream edge of the fixing nip in a recording medium conveyance direction. A downstream projection projects from the base in the pressurization direction of the opposed rotary body at a position on the base corresponding to or downstream from a downstream edge of the fixing nip in the recording medium conveyance direction. The downstream projection is spaced apart from the upstream projection in the recording medium conveyance direction.

24 Claims, 7 Drawing Sheets

(56) References Cited

U.S. PATENT DOCUMENTS

| | | | | |
|---|---|---|---|---|
| 2006/0029411 | A1 | 2/2006 | Ishii et al. | |
| 2007/0212089 | A1 | 9/2007 | Seo et al. | |
| 2007/0242988 | A1 | 10/2007 | Seo et al. | |
| 2007/0258742 | A1* | 11/2007 | Narahara et al. | 399/329 |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0175633 | A1 | 7/2008 | Shinshi | |
| 2008/0219721 | A1 | 9/2008 | Ito et al. | |
| 2008/0219730 | A1 | 9/2008 | Shinshi | |
| 2008/0226326 | A1 | 9/2008 | Seo et al. | |
| 2008/0232873 | A1 | 9/2008 | Ueno et al. | |
| 2009/0041515 | A1 | 2/2009 | Kim | |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0158587 | A1 | 6/2010 | Shin | |
| 2010/0196065 | A1* | 8/2010 | Matsuki et al. | 399/329 |
| 2010/0202809 | A1 | 8/2010 | Shinshi et al. | |
| 2010/0232822 | A1 | 9/2010 | Takenaka et al. | |
| 2010/0290822 | A1 | 11/2010 | Hasegawa et al. | |
| 2010/0303521 | A1 | 12/2010 | Ogawa et al. | |
| 2011/0020018 | A1 | 1/2011 | Takenaka et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |

FOREIGN PATENT DOCUMENTS

| | | | |
|---|---|---|---|
| JP | 2004-094146 | | 3/2004 |
| JP | 2004-258484 | A | 9/2004 |
| JP | 2004-286922 | | 10/2004 |
| JP | 2005-092080 | | 4/2005 |
| JP | 2005-258484 | | 9/2005 |
| JP | 2007-171749 | A | 7/2007 |
| JP | 2007-233011 | | 9/2007 |
| JP | 2007-334205 | | 12/2007 |
| JP | 2008-145903 | A | 6/2008 |
| JP | 2008-158482 | | 7/2008 |
| JP | 2008-216928 | | 9/2008 |
| JP | 2010-078839 | | 4/2010 |
| JP | 2010-079309 | | 4/2010 |
| JP | 2010-217431 | A | 9/2010 |
| JP | 2011-22430 | A | 2/2011 |
| JP | 2011-059365 | A | 3/2011 |
| JP | 2011-215555 | | 10/2011 |
| JP | 5092239 | B2 | 12/2012 |

OTHER PUBLICATIONS

U.S. Appl. No. 13/677,597, filed Nov. 15, 2012, Kawata, et al.
U.S. Appl. No. 13/692,389, filed Dec. 30, 2012, Gotoh, et al.
U.S. Appl. No. 13/716,929, filed Dec. 17, 2012, Kawata, et al.
U.S. Appl. No. 13/717,046, filed Dec. 17, 2012, Iwaya, et al.
Extended Search Report issued May 17, 2013 in European Application No. 12198941.2.
Japanese Office Action issued Dec. 1, 2014 in JP Patent Application No. 2011-289277.

* cited by examiner

FIXING DEVICE WITH SUPPORT AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-289277, filed on Dec. 28, 2011, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time required to output the recording medium bearing the toner image onto the outside of the image forming apparatus after the image forming apparatus receives a print job. Additionally, the fixing device is requested to generate an increased amount of heat before a plurality of recording media is conveyed through the fixing device continuously at an increased speed.

To address these requests, the fixing device may employ an endless belt having a decreased thermal capacity and therefore heated quickly by a heater. FIG. 1 illustrates a fixing device 20R1 incorporating an endless belt 100 heated by a heater 300. As shown in FIG. 1, a pressing roller 400 is pressed against a tubular metal thermal conductor 200 disposed inside a loop formed by the endless belt 100 to form a fixing nip N between the pressing roller 400 and the endless belt 100. The heater 300 disposed inside the metal thermal conductor 200 heats the entire endless belt 100 via the metal thermal conductor 200. As the pressing roller 400 rotating clockwise and the endless belt 100 rotating counterclockwise in FIG. 1 convey a recording medium P bearing a toner image T through the fixing nip N in a recording medium conveyance direction A1, the endless belt 100 and the pressing roller 400 apply heat and pressure to the recording medium P, thus fixing the toner image T on the recording medium P.

Since the metal thermal conductor 200 heats the endless belt 100 entirely, the endless belt 100 is heated to a predetermined fixing temperature quickly, thus meeting the above-described requests of shortening the first print time and generating the increased amount of heat for high speed printing. However, in order to shorten the first print time further and save more energy, the fixing device is requested to heat the endless belt more efficiently. To address this request, a configuration to heat the endless belt directly, not via the metal thermal conductor, is proposed as shown in FIG. 2.

FIG. 2 illustrates a fixing device 20R2 in which the heater 300 heats the endless belt 100 directly. Instead of the metal thermal conductor 200 depicted in FIG. 1, a nip formation member 502, disposed inside the loop formed by the endless belt 100, presses against the pressing roller 400 via the endless belt 100 to form the fixing nip N between the endless belt 100 and the pressing roller 400. Since the nip formation member 502 does not encircle the heater 300, unlike the metal thermal conductor 200 depicted in FIG. 1, the heater 300 heals the endless belt 100 directly. However, the nip formation member 502 is subject to bending as it receives pressure from the pressing roller 400. If the nip formation member 502 is bent, it presses against the pressing roller 400 with various levels of pressure in the axial direction of the pressing roller 400. Accordingly, the endless belt 100 and the pressing roller 400 may not apply heat and pressure uniformly to the recording medium P conveyed through the fixing nip N, resulting in faulty fixing.

SUMMARY OF THE INVENTION

This specification describes below an improved fixing device. In one exemplary embodiment of the present invention, the fixing device includes an endless belt rotatable in a predetermined direction of rotation; a nip formation assembly disposed opposite an inner circumferential surface of the endless belt; an opposed rotary body pressed against the nip formation assembly in a pressurization direction via the endless belt to form a fixing nip between the endless belt and the opposed rotary body through which a recording medium bearing a toner image is conveyed; and a support contacting and supporting the nip formation assembly. The support includes a base contacting the nip formation assembly; an upstream projection projecting from the base in the pressurization direction of the opposed rotary body at a position on the base corresponding to or upstream from an upstream edge of the fixing nip in a recording medium conveyance direction; and a downstream projection projecting from the base in the pressurization direction of the opposed rotary body at a position on the base corresponding to or downstream from a downstream edge of the fixing nip in the recording medium conveyance direction. The downstream projection is spaced apart from the upstream projection in the recording medium conveyance direction.

This specification further describes an improved image forming apparatus. In one exemplary embodiment of the present invention, the image forming apparatus includes the fixing device described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
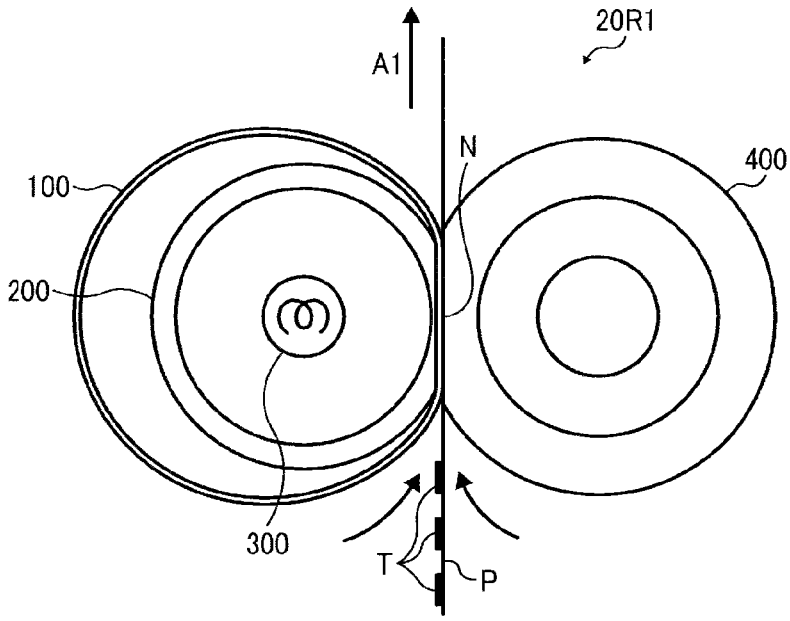
FIG. 1 RELATED ART
FIG. 1 is a vertical sectional view of a related-art fixing device.
Figure 2:
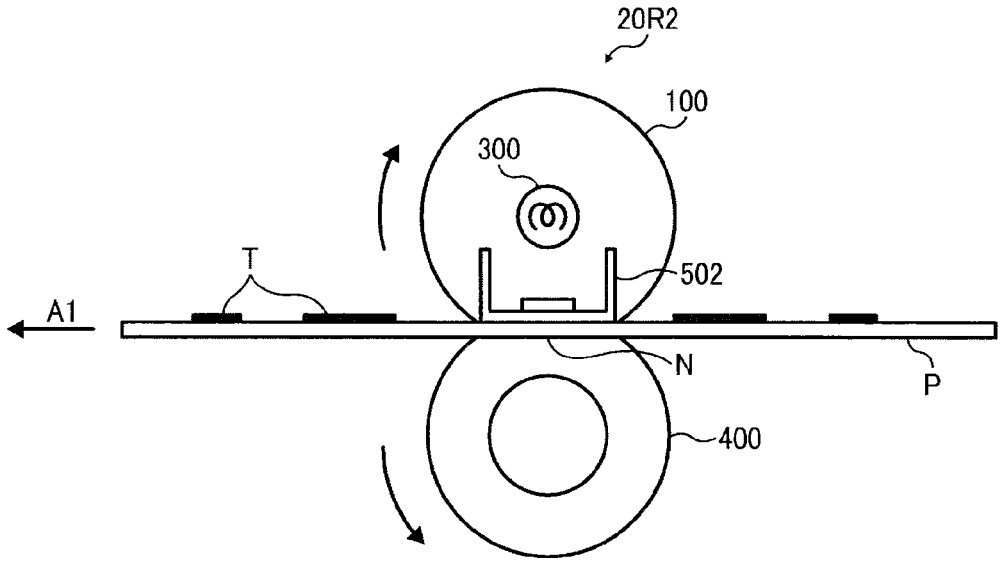
FIG. 2 RELATED ART
FIG. 2 is a vertical sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
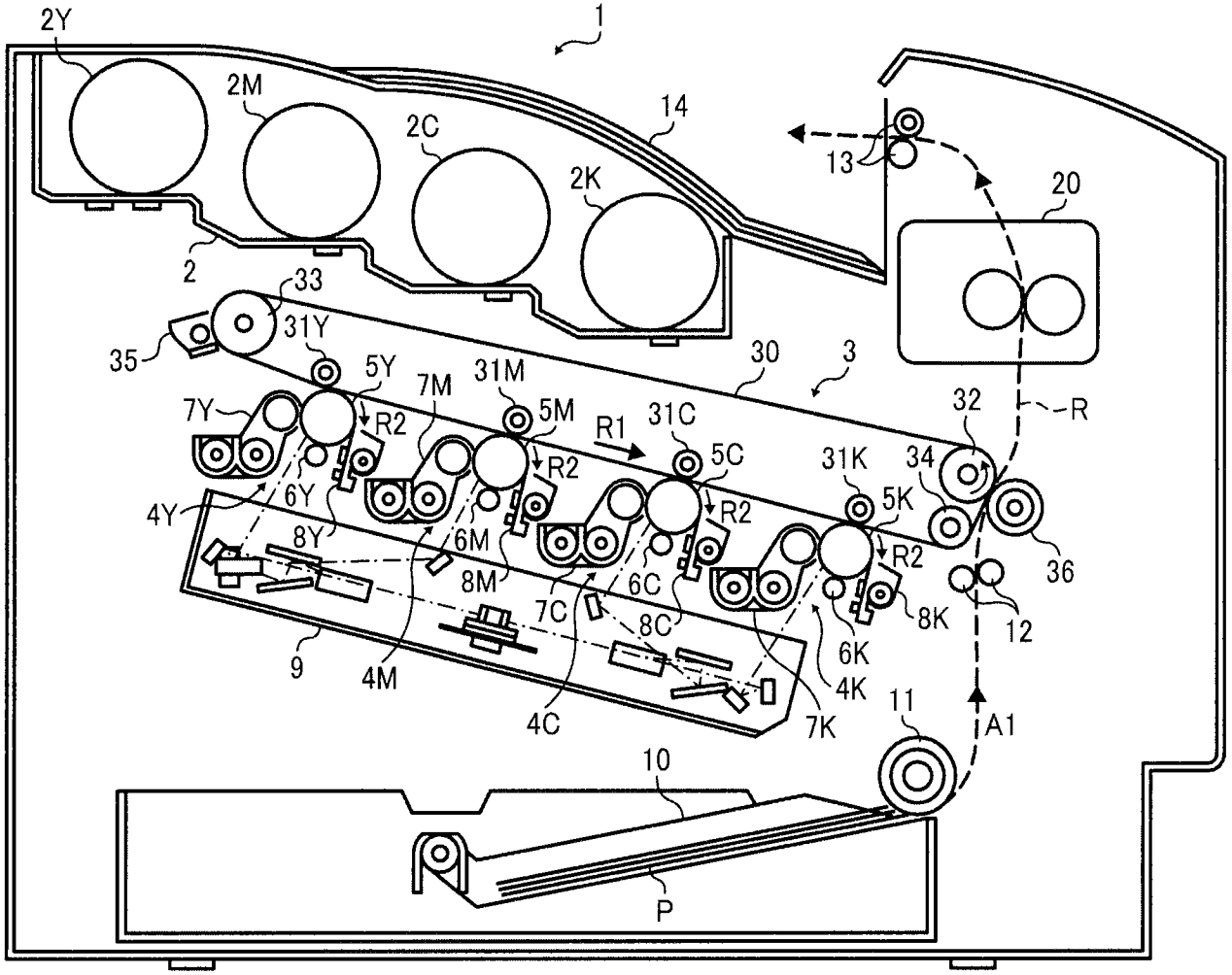
FIG. 3 is a schematic vertical sectional view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this exemplary embodiment, the image forming apparatus 1 is a color laser printer that forms a toner image on a recording medium P by electrophotography.

As shown in FIG. 3, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, the image forming devices 4Y, 4M, 4C, and 4K include drum-shaped photoconductors 5Y, 5M, 5C, and 5K serving as an image carrier that carries an electrostatic latent image and a resultant toner image; chargers 6Y, 6M, 6C, and 6K that charge an outer circumferential surface of the respective photoconductors 5Y, 5M, 5C, and 5K; development devices 7Y, 7M, 7C, and 7K that supply yellow, magenta, cyan, and black toners to the electrostatic latent images formed on the outer circumferential surface of the respective photoconductors 5Y, 5M, 5C, and 5K, thus visualizing the electrostatic latent images into yellow, magenta, cyan, and black toner images with the yellow, magenta, cyan, and black toners, respectively; and cleaners 8Y, 8M, 8C, and 8K that clean the outer circumferential surface of the respective photoconductors 5Y, 5M, 5C, and 5K.

Below the image forming devices 4Y, 4M, 4C, and 4K is an exposure device 9 that exposes the outer circumferential surface of the respective photoconductors 5Y, 5M, 5C, and 5K with laser beams. For example, the exposure device 9, constructed of a light source, a polygon mirror, an f-θ lens, reflection mirrors, and the like, emits a laser beam onto the outer circumferential surface of the respective photoconductors 5Y, 5M, 5C, and 5K according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31Y, 31M, 31C, and 31K serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched over the secondary transfer backup roller 32, the cleaning backup roller 33, and the tension roller 34. As a driver drives and rotates the secondary transfer backup roller 32, the secondary transfer backup roller 32 rotates the intermediate transfer belt 30 in a rotation direction R1 by friction therebetween.

The four primary transfer rollers 31Y, 31M, 31C, and 31K sandwich the intermediate transfer belt 30 together with the four photoconductors 5Y, 5M, 5C, and 5K, respectively, forming four primary transfer nips between the intermediate transfer belt 30 and the photoconductors 5Y, 5M, 5C, and 5K. The primary transfer rollers 31Y, 31M, 31C, and 31K are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31Y, 31M, 31C, and 31K, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the development devices 7Y, 7M, 7C, and 7K through toner supply tubes interposed between the toner bottles 2Y, 2M, 2C, and 2K and the development devices 7Y, 7M, 7C, and 7K, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, tracing paper, OHP (overhead projector) transparencies, OHP film sheets, and the like. Additionally, a bypass tray may be attached to the image forming apparatus 1 that loads postcards, envelopes, OHP transparencies, OHP film sheets, and the like.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 3, a description is provided of an image forming operation of the image forming apparatus 1 having the structure described above to form a color toner image on a recording medium P.

As a print job starts, a driver drives and rotates the photoconductors 5Y, 5M, 5C, and 5K of the image forming devices 4Y, 4M, 4C, and 4K, respectively, clockwise in FIG. 3 in a rotation direction R2. The chargers 6Y, 6M, 6C, and 6K uniformly charge the outer circumferential surface of the respective photoconductors 5Y, 5M, 5C, and 5K at a predetermined polarity. The exposure device 9 emits laser beams onto the charged outer circumferential surface of the respective photoconductors 5Y, 5M, 5C, and 5K according to yellow, magenta, cyan, and black image data contained in color image data sent from the external device, respectively, thus forming electrostatic latent images thereon. The development devices 7Y, 7M, 7C, and 7K supply yellow, magenta, cyan, and black toners to the electrostatic latent images formed on the photoconductors 5Y, 5M, 5C, and 5K, visualizing the electrostatic latent images into yellow, magenta, cyan, and black toner images, respectively.

Simultaneously, as the print job starts, the secondary transfer backup roller 32 is driven and rotated counterclockwise in FIG. 3, rotating the intermediate transfer belt 30 in the rotation direction R1 by friction therebetween. A power supply applies a constant voltage or a constant current control voltage having a polarity opposite a polarity of the toner to the primary transfer rollers 31Y, 31M, 31C, and 31K. Thus, a transfer electric field is created at the primary transfer nips formed between the primary transfer rollers 31Y, 31M, 31C, and 31K and the photoconductors 5Y, 5M, 5C, and 5K, respectively.

When the yellow, magenta, cyan, and black toner images formed on the photoconductors 5Y, 5M, 5C, and 5K reach the primary transfer nips, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 30 by the transfer electric field created at the primary transfer nips in such a manner that the yellow, magenta, cyan, and black toner images are superimposed successively on a same position on the intermediate transfer belt 30. Thus, the color toner image is formed on the intermediate transfer belt 30. After the primary transfer of the yellow, magenta, cyan, and black toner images from the photoconductors 5Y, 5M, 5C, and 5K onto the intermediate transfer belt 30, the cleaners 8Y, 8M, 8C, and 8K remove residual toner not transferred onto the intermediate transfer belt 30 and therefore remaining on the photoconductors 5Y, 5M, 5C, and 5K therefrom. Thereafter, dischargers discharge the outer circumferential surface of the respective photoconductors 5Y, 5M, 5C, and 5K, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner not transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 4:
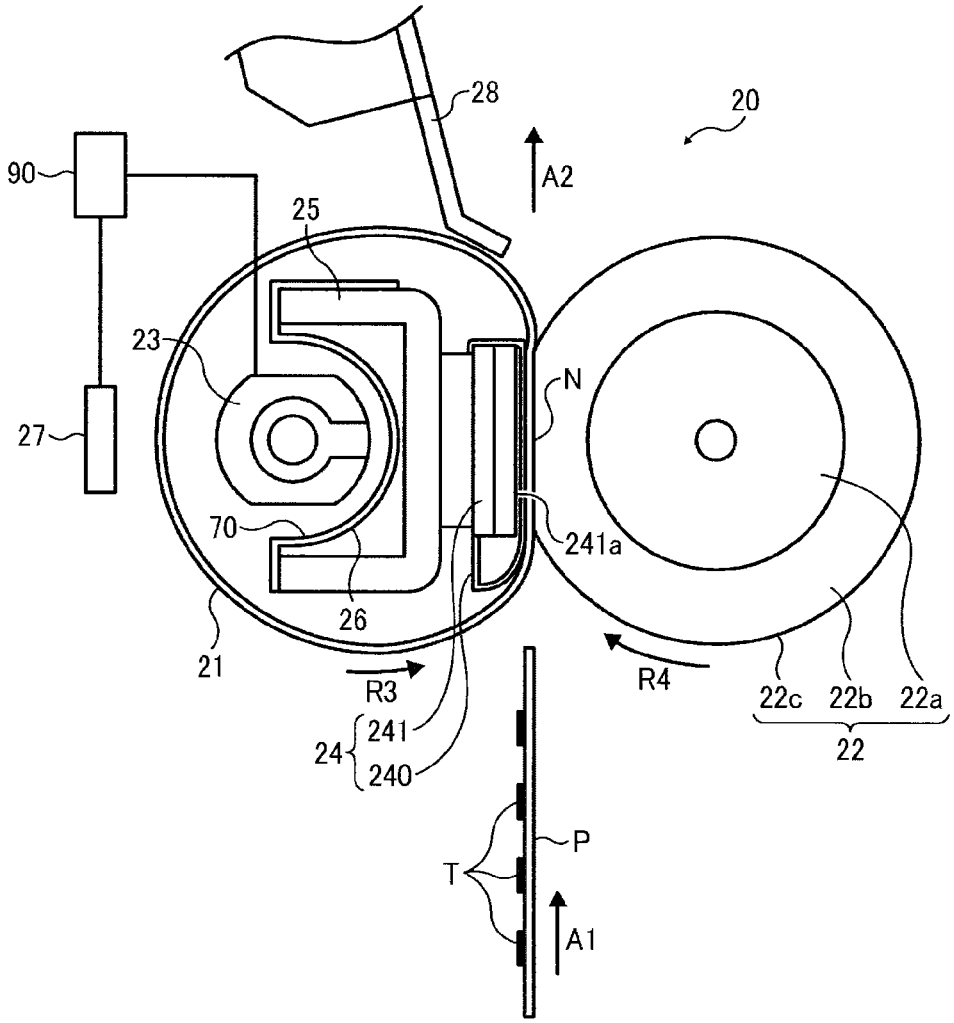
FIG. 4 is a vertical sectional view of a fixing device installed in the image forming apparatus shown in FIG. 3.

With reference to FIG. 4, a description is provided of a construction of the fixing device 20 incorporated in the image forming apparatus 1 described above.

FIG. 4 is a vertical sectional view of the fixing device 20. As shown in FIG. 4, the fixing device 20 (e.g., a fuser) includes a fixing belt 21 serving as a fixing rotary body or an endless belt formed into a loop and rotatable in a rotation direction R3; a pressing roller 22 serving as an opposed rotary body disposed opposite an outer circumferential surface of the fixing belt 21 and rotatable in a rotation direction R4 counter to the rotation direction R3 of the fixing belt 21; a halogen heater 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater 23 toward the fixing belt 21; a temperature sensor 27 serving as a temperature detector disposed opposite the outer circumferential surface of the fixing belt 21 and detecting the temperature of the fixing belt 21; and a separator 28 disposed opposite the outer circumferential surface of the fixing belt 21 and separating the recording medium P from the fixing belt 21. The fixing device 20 further includes a pressurization assembly that presses the pressing roller 22 against the nip formation assembly 24 via the fixing belt 21.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer, made of rubber such as silicone rubber, silicone rubber foam, and fluoro rubber, may be interposed between the base layer and the release layer.

A detailed description is now given of a construction of the pressing roller 22. The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. A driver (e.g., a motor) disposed inside the image forming apparatus 1 depicted in FIG. 3 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. If the pressing roller 22 does not incorporate the elastic layer 22*b*, the pressing roller 22 has a decreased thermal capacity that improves fixing performance of being heated to the predetermined fixing temperature quickly. However, as the pressing roller 22 and the fixing belt 21 sandwich and press a toner image T on the recording medium P passing through the fixing nip N, slight surface asperities of the fixing belt 21 may be transferred onto the toner image T on the recording medium P, resulting in variation in gloss of the solid toner image T. To address this problem, it is preferable that the pressing roller 22 incorporates the elastic layer 22*b* having a thickness not smaller than about 100 micrometers. The elastic layer 22*b* having the thickness not smaller than about 100 micrometers elastically deforms to absorb slight surface asperities of the fixing belt 21, preventing variation in gloss of the toner image T on the recording medium P. The elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater 23.

Both lateral ends of the halogen heater 23 in a longitudinal direction thereof parallel to an axial direction of the fixing belt 21 are mounted on side plates of the fixing device 20, respectively. A power supply situated inside the image forming apparatus 1 supplies power to the halogen heater 23 so that the halogen heater 23 heats the fixing belt 21. A controller 90, that is, a central processing unit (CPU), provided with a random-access memory (RAM) and a read-only memory (ROM), for example, operatively connected to the halogen heater 23 and the temperature sensor 27 controls the halogen heater 23 based on the temperature of the fixing belt 21 detected by the temperature sensor 27 so as to adjust the temperature of the fixing belt 21 to a desired fixing temperature. Alternatively, an induction heater, a resistance heat generator, a carbon heater, or the like may be employed as a heater to heat the fixing belt 21 instead of the halogen heater 23.

A detailed description is now given of a construction of the nip formation assembly 24.

The nip formation assembly 24 includes a base pad 241 and a slide sheet 240 (e.g., a low-friction sheet) covering an outer surface of the base pad 241. A longitudinal direction of the base pad 241 is parallel to an axial direction of the fixing belt 21 or the pressing roller 22. The base pad 241 receives pressure from the pressing roller 22 to define the shape of the fixing nip N. The base pad 241 is mounted on and supported by the stay 25. Accordingly, even if the base pad 241 receives pressure from the pressing roller 22, the base pad 241 is not bent by the pressure and therefore produces a uniform nip width throughout the axial direction of the pressing roller 22. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as liquid crystal polymer (LCP), metal, ceramic, or the like.

The base pad 241 is made of a heat-resistant material having a heat resistance temperature not lower than about 200 degrees centigrade. Accordingly, even if the base pad 241 is heated to a predetermined fixing temperature range, the base pad 241 is not thermally deformed, thus retaining the desired shape of the fixing nip N stably and thereby maintaining the quality of the fixed toner image T on the recording medium P.

For example, the base pad 241 is made of general heat-resistant resin such as polyether sulfone (PES), polyphenylene sulfide (PPS), liquid crystal polymer (LCP), polyether nitrile (PEN), polyamide imide (PAT), polyether ether ketone (PEEK), or the like.

The slide sheet 240 covers at least an opposed face 241*a* of the base pad 241 disposed opposite the fixing belt 21 at the fixing nip N. As the fixing belt 21 rotates in the rotation direction R3, the fixing belt 21 slides over the slide sheet 240, decreasing a driving torque exerted on the fixing belt 21. Accordingly, a decreased friction is imposed onto the fixing belt 21 from the nip formation assembly 24. Alternatively, the nip formation assembly 24 may not incorporate the slide sheet 240.

A detailed description is now given of a construction of the reflector 26.

The reflector 26 is interposed between the stay 25 and the halogen heater 23. According to this exemplary embodiment, the reflector 26 is mounted on the stay 25. Since the reflector 26 is directly heated by the halogen heater 23, the reflector 26 is made of metal having a relatively high melting point. For example, the reflector 26 is made of aluminum, stainless steel, or the like. The reflector 26 has a reflection face 70 that reflects light radiated from the halogen heater 23 thereto toward the fixing belt 21. Accordingly, the fixing belt 21 receives an increased amount of light from the halogen heater 23 and thereby is heated efficiently. Additionally, the reflector 26 minimizes transmission of radiation heat from the halogen heater 23 to the stay 25, thus saving energy.

Alternatively, instead of mounting the reflector 26 on the stay 25, an opposed face of the stay 25 disposed opposite the halogen heater 23 may be mirror finished by polishing or coating to produce a reflection face that reflects light from the halogen heater 23 toward the fixing belt 21. The reflection face 70 of the reflector 26 or the reflection face of the stay 25 has a reflection rate not smaller than about 90 percent.

Since the stay 25 is required to have a predetermined mechanical strength great enough to support the nip formation assembly 24, the shape and material of the stay 25 are limited. To address this circumstance, the reflector 26 separately provided from the stay 25 attains flexibility in the shape and material of the stay 25. Consequently, the reflector 26 and the stay 25 are tailored to fit their specific purposes, respectively. Since the reflector 26 is interposed between the halogen heater 23 and the stay 25, the reflector 26 is situated in proximity to the halogen heater 23, reflecting light from the halogen heater 23 to the fixing belt 21 efficiently.

In order to heat the fixing belt 21 more efficiently by reflecting light from the halogen heater 23 toward the fixing belt 21, the reflection face 70 of the reflector 26 or the reflection face of the stay 25 is directed properly.

Figure 5A:
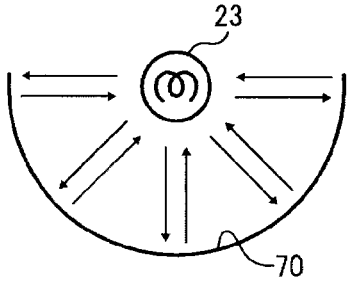
FIG. 5A is a partial vertical sectional view of a halogen heater and a reflection face of a reflector incorporated in the fixing device shown in FIG. 4 illustrating one example of the reflection face.
Figure 5B:
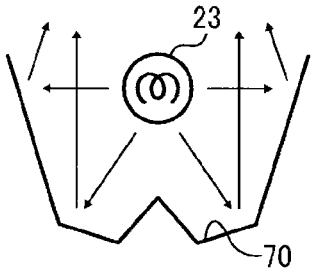
FIG. 5B is a partial vertical sectional view of the halogen heater and the reflection face of the reflector illustrating another example of the reflection face.

With reference to FIGS. 5A and 5B, a description is provided of the direction of the reflection face 70 of the reflector 26.

FIG. 5A is a partial vertical sectional view of the halogen heater 23 and the reflection face 70 of the reflector 26 illustrating one example of the reflection face 70. FIG. 5B is a partial vertical sectional view of the halogen heater 23 and the reflection face 70 of the reflector 26 illustrating another example of the reflection face 70. As shown in FIG. 5A, if the reflection face 70 is concentrically shaped with respect to the halogen heater 23, the reflection face 70 reflects light from the halogen heater 23 back to the halogen heater 23, degrading heating efficiency for heating the fixing belt 21. Conversely, as shown in FIG. 5B, if the reflection face 70 is partially or entirely shaped to reflect light from the halogen heater 23 in directions other than a direction toward the halogen heater 23, the reflection face 70 reflects a decreased amount of light toward the halogen heater 23, improving heating efficiency for heating the fixing belt 21 by light reflection.

The fixing device 20 according to this exemplary embodiment attains various improvements to save more energy and shorten a first print time required to output a recording medium P bearing a fixed toner image T onto the outside of the image forming apparatus 1 depicted in FIG. 3 after the image forming apparatus 1 receives a print job. As a first improvement, the fixing device 20 employs a direct heating method in which the halogen heater 23 directly heats the fixing belt 21 at a portion of the fixing belt 21 other than a nip portion thereof facing the fixing nip N. For example, as shown in FIG. 4, no component is interposed between the halogen heater 23 and the fixing belt 21 at an outward portion of the fixing belt 21 disposed opposite the temperature sensor 27. Accordingly, radiation heat from the halogen heater 23 is directly transmitted to the fixing belt 21 at the outward portion thereof.

As a second improvement, the fixing belt 21 is designed to be thin and have a reduced loop diameter so as to decrease the thermal capacity of the fixing belt 21. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. The loop diameter of the fixing belt 21 is in a range of from about 20 mm to about 40 mm. In order to decrease the thermal capacity of the fixing belt 21 further, the fixing belt 21 may have a total thickness not greater than about 0.20 mm, preferably not greater than about 0.16 mm. Additionally, the loop diameter of the fixing belt 21 may be not greater than about 30 mm.

According to this exemplary embodiment, the pressing roller 22 has a diameter in a range of from about 20 mm to about 40 mm so that the loop diameter of the fixing belt 21 is equivalent to the diameter of the pressing roller 22. However, the loop diameter of the fixing belt 21 and the diameter of the pressing roller 22 are not limited to the above. For example, the loop diameter of the fixing belt 21 may be smaller than the diameter of the pressing roller 22. In this case, the curvature of the fixing belt 21 at the fixing nip N is smaller than that of the pressing roller 22, facilitating separation of the recording medium P discharged from the fixing nip N from the fixing belt 21.

Figure 6A:
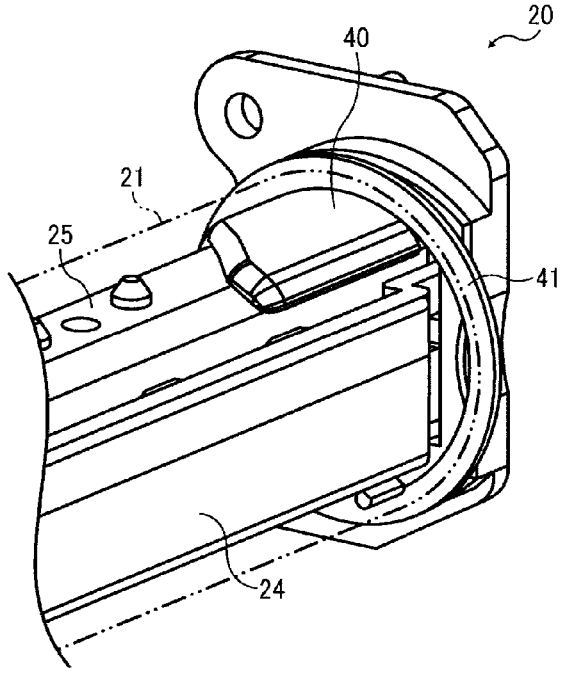
FIG. 6A is a perspective view of one lateral end of a fixing belt incorporated in the fixing device shown in FIG. 4 in an axial direction of the fixing belt.
Figure 6B:
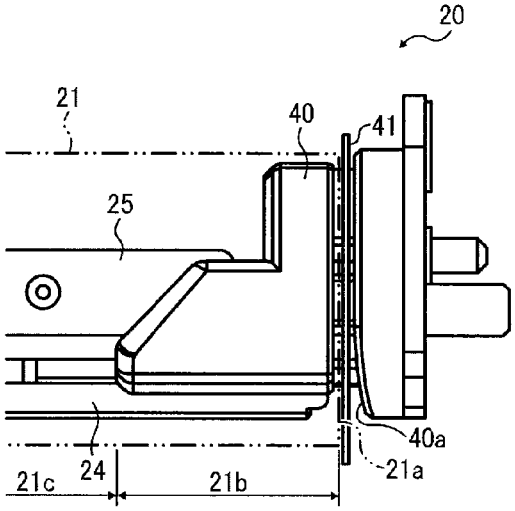
FIG. 6B is a plan view of one lateral end of the fixing belt in the axial direction thereof shown in FIG. 6A.
Figure 6C:
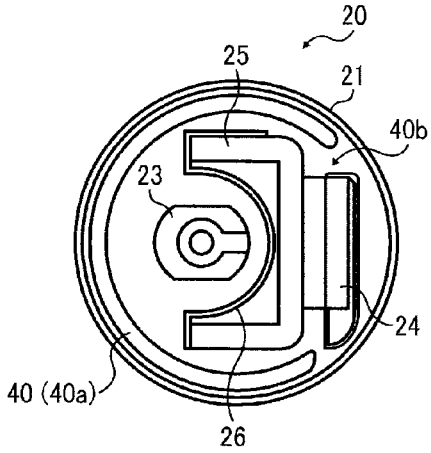
FIG. 6C is a vertical sectional view of one lateral end of the fixing belt in the axial direction thereof shown in FIG. 6A.

With reference to FIGS. 6A, 6B, and 6C, a description is provided of a configuration of a lateral end of the fixing belt 21 in the axial direction thereof.

FIG. 6A is a perspective view of one lateral end of the fixing belt 21 in the axial direction thereof. FIG. 6B is a plan view of one lateral end of the fixing belt 21 in the axial direction thereof. FIG. 6C is a vertical sectional view of one lateral end of the fixing belt 21 in the axial direction thereof. Although not shown, another lateral end of the fixing belt 21 in the axial direction thereof has the identical configuration shown in FIGS. 6A to 6C. Hence, the following describes the configuration of one lateral end of the fixing belt 21 in the axial direction thereof with reference to FIGS. 6A to 6C.

As shown in FIGS. 6A and 6B, a belt holder 40 is inserted into the loop formed by the fixing belt 21 at a lateral end 21*b* of the fixing belt 21 in the axial direction thereof to rotatably support the fixing belt 21. As shown in FIG. 6B, the belt holder 40 contacts and rotatably supports each lateral end 21*b* of the fixing belt 21 in the axial direction thereof. Conversely, the nip formation assembly 24 supports a center 21*c* of the fixing belt 21 in the axial direction thereof. As shown in FIG. 6C, the belt holder 40 is C-shaped in cross-section to create an opening 40*b* at the fixing nip N where the nip formation assembly 24 is situated.

As shown in FIG. 6B, a lateral end of the stay 25 in a longitudinal direction thereof parallel to the axial direction of the fixing belt 21 is mounted on and positioned by the belt holder 40.

As shown in FIG. 6B, a slip ring 41 is interposed between a lateral edge 21*a* of the fixing belt 21 and an inward face 40*a* of the belt holder 40 disposed opposite the lateral edge 21*a* of the fixing belt 21 in the axial direction thereof. The slip ring 41 serves as a protector that protects the lateral end 21*b* of the fixing belt 21 in the axial direction thereof. For example, even if the fixing belt 21 is skewed in the axial direction thereof, the slip ring 41 prevents the lateral edge 21*a* of the fixing belt 21 from coming into contact with the inward face 40*a* of the belt holder 40 directly, thus minimizing wear and breakage of the lateral end 21*b* of the fixing belt 21 in the axial direction thereof. Since an inner diameter of the slip ring 41 is sufficiently greater than an outer diameter of the belt holder 40, the slip ring 41 loosely slips on the belt holder 40. Accordingly, when the lateral edge 21*a* of the fixing belt 21 comes into contact with the slip ring 41, the slip ring 41 is rotatable in accordance with rotation of the fixing belt 21. Alternatively, the slip ring 41 may be stationary irrespective of rotation of the fixing belt 21. The slip ring 41 is made of heat-resistant, super engineering plastics such as PEEK, PPS, PAI, and PTFE.

A shield is interposed between the halogen heater 23 and the fixing belt 21 at both lateral ends 21*b* of the fixing belt 21 in the axial direction thereof. The shield shields the fixing belt 21 against heat from the halogen heater 23. For example, even if a plurality of small recording media P is conveyed through the fixing nip N continuously, the shield prevents heat from the halogen heater 23 from being conducted to both lateral ends 21*b* of the fixing belt 21 in the axial direction thereof where the small recording media P are not conveyed. Accordingly, both lateral ends 21*b* of the fixing belt 21 do not overheat even in the absence of large recording media P that draw heat therefrom. Consequently, the shield minimizes thermal wear and damage of the fixing belt 21.

With reference to FIG. 4, a description is provided of a fixing operation of the fixing device 20 described above.

As the image forming apparatus 1 depicted in FIG. 3 is powered on, the power supply supplies power to the halogen heater 23 and at the same time the driver drives and rotates the pressing roller 22 clockwise in FIG. 4 in the rotation direction R4. Accordingly, the fixing belt 21 rotates counterclockwise in FIG. 4 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the pressing roller 22 and the fixing belt 21 pressed by the pressing roller 22. The fixing belt 21 heated by the halogen heater 23 heats the recording medium P and at the same time the pressing roller 22 pressed against the fixing belt 21 and the fixing belt 21 together exert pressure to the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of the separator 28, the separator 28 separates the recording medium P from the fixing belt 21. Thereafter, the recording medium P is discharged by the output roller pair 13 depicted in FIG. 3 onto the outside of the image forming apparatus 1, that is, the output tray 14 where the recording media P are stocked.

Figure 7:
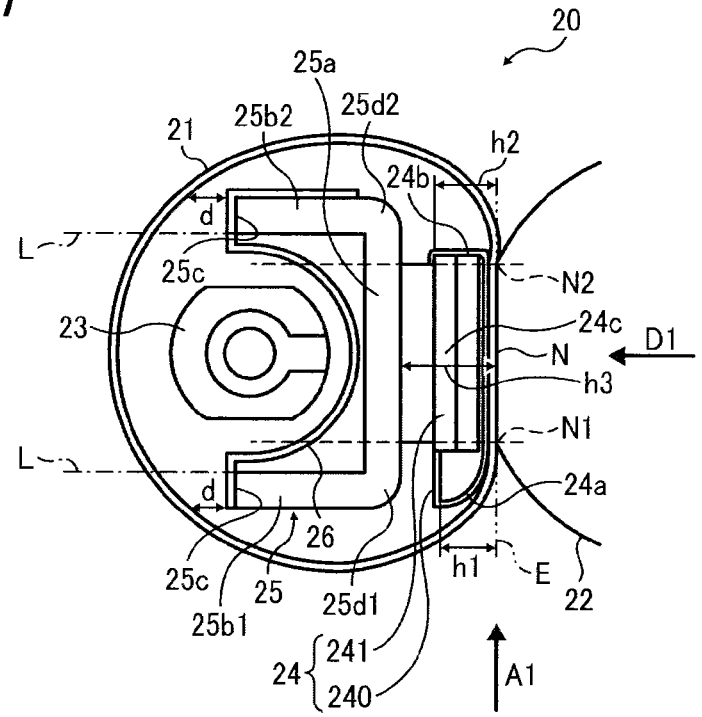
FIG. 7 is a partial vertical sectional view of the fixing device shown in FIG. 4.

With reference to FIG. 7, a detailed description is now given of a construction of the stay 25.

FIG. 7 is a partial vertical sectional view of the fixing device 20. As shown in FIG. 7, the stay 25 includes a base 25*a* contacting the nip formation assembly 24 and an upstream projection 25*b*1 and a downstream projection 25*b*2, constituting a pair of projections, projecting from the base 25*a*. The base 25*a* extends in the recording medium conveyance direction A1, that is, a vertical direction in FIG. 7. The upstream projection 25*b*1 and the downstream projection 25*b*2 project from an upstream end and a downstream end of the base 25*a*, respectively, in the recording medium conveyance direction A1 and extend in a pressurization direction D1 of the pressing roller 22 orthogonal to the recording medium conveyance direction A1. The downstream projection 25*b*2 is spaced apart from the upstream projection 25*b*1 in the recording medium conveyance direction A1. For example, the upstream projection 25*b*1 and the downstream projection 25*b*2 are situated outboard from the fixing nip N in the recording medium conveyance direction A1. In other words, the upstream projection 25*b*1 is situated upstream from an upstream edge N1 of the fixing nip N in the recording medium conveyance direction A1, that is, below the fixing nip N in FIG. 7; the downstream projection 25*b*2 is situated downstream from a downstream edge N2 of the fixing nip N in the recording medium conveyance direction A1, that is, above the fixing nip N in FIG. 7.

The upstream projection 25*b*1 and the downstream projection 25*b*2 projecting from the base 25*a* in the pressurization direction D1 of the pressing roller 22 elongate a cross-sectional area of the stay 25 in the pressurization direction D1 of the pressing roller 22, increasing the section modulus and the mechanical strength of the stay 25.

Figure 8:
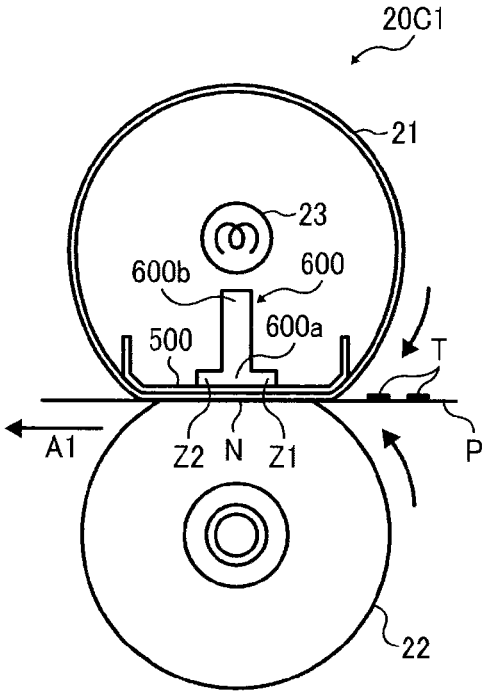
FIG. 8 is a partial vertical sectional view of a comparative fixing device.

With reference to FIG. 8, a description is provided of a comparative fixing device 20C1 incorporating a single projection 600*b*.

FIG. 8 is a partial vertical sectional view of the comparative fixing device 20C1. As shown in FIG. 8, the comparative fixing device 20C1 includes a support 600 supporting a nip formation pad 500 that receives pressure from the pressing roller 22. The support 600 is constructed of a horizontal base 600*a* in contact with the nip formation pad 500 and the projection 600*b* projecting from the base 600*a* substantially vertically at a center of the base 600*a* in the recording medium conveyance direction A1. However, since the projection 600*b* is not provided at an upstream end Z1 and a downstream end Z2 of the base 600*a* in the recording medium conveyance direction A1, the base 600*a* may be bent by pressure from the pressing roller 22.

Figure 9:
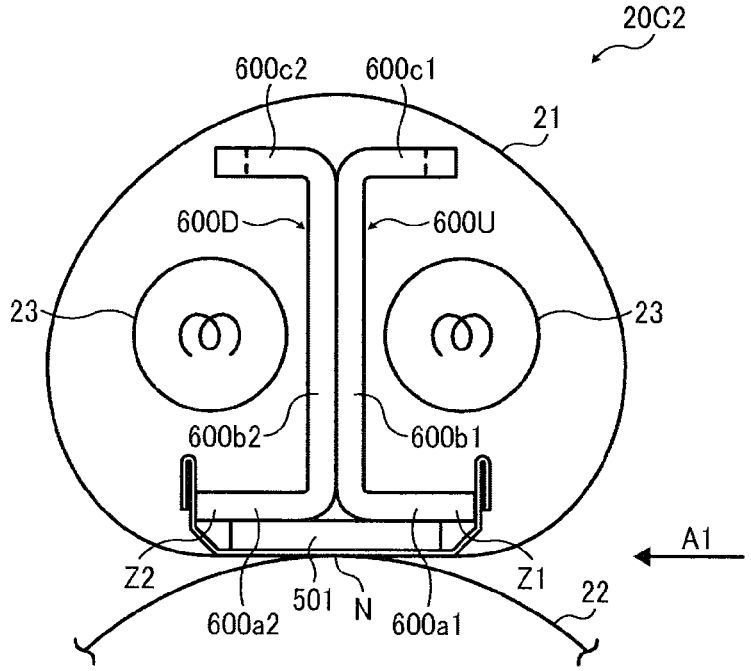
FIG. 9 is a partial vertical sectional view of another comparative fixing device.

With reference to FIG. 9, a description is provided of another comparative fixing device 20C2 incorporating an upstream projection 600*b*1 and a downstream projection 600*b*2 in contact with each other.

FIG. 9 is a partial vertical sectional view of the comparative fixing device 20C2. As shown in FIG. 9, the comparative fixing device 20C2 includes two supports, that is an upstream support 600U and a downstream support 600D supporting a nip formation pad 501 that receives pressure from the pressing roller 22. The upstream support 6000 is constructed of a horizontal base 600*a*1 in contact with the nip formation pad 501; the upstream projection 600*b*1 projecting from the base 600*a*1 substantially vertically; and a radiation adjuster 600*c*1 projecting from an upper end of the upstream projection 600*b*1 horizontally. Similarly, the downstream support 600D is constructed of a horizontal base 600*a*2 in contact with the nip formation pad 501; the downstream projection 600*b*2 projecting from the base 600*a*2 substantially vertically; and a radiation adjuster 600*c*2 projecting from an upper end of the downstream projection 600*b*2 horizontally.

The upstream projection 600*b*1 contacts the downstream projection 600*b*2 along a vertical line extending vertically from a center of the nip formation pad 501 in the recording medium conveyance direction A1. Each of the radiation adjusters 600*c*1 and 600*c*2 is produced with a plurality of slits aligned in the axial direction of the fixing belt 21, thus adjusting radiation time of light radiated from the halogen heaters 23 to the fixing belt 21 in the axial direction thereof. However, since the upstream projection 600*b*1 and the downstream projection 600*b*2 are not provided at an upstream end Z1 and a downstream end Z2 of the bases 600*a*1 and 600*a*2, respectively, the bases 600*a*1 and 600*a*2 may be bent by pressure from the pressing roller 22.

To address this problem, according to this exemplary embodiment shown in FIG. 7, the downstream projection 25*b*2 is spaced apart from the upstream projection 25*b*1 in the recording medium conveyance direction A1, not in contact with the upstream projection 25*b*1 unlike the configurations shown in FIGS. 8 and 9, thus enhancing the mechanical strength of the base 25*a* interposed between the upstream projection 25*b*1 and the downstream projection 25*b*2 in the recording medium conveyance direction A1.

Additionally, the upstream projection 25*b*1 and the downstream projection 25*b*2 are situated outboard from the upstream edge N1 and the downstream edge N2 of the fixing nip N, respectively, in the recording medium conveyance direction A1. Accordingly, the upstream projection 25*b*1 and the downstream projection 25*b*2 support the base 25*a* at both ends of the base 25*a* in the recording medium conveyance direction A1 situated outboard from a center of the base 25*a* corresponding to the fixing nip N, where the base 25*a* receives pressure from the pressing roller 22. According to this exemplary embodiment, the upstream projection 25*b*1 and the downstream projection 25*b*2 projecting from both ends of the base 25*a* in the recording medium conveyance direction A1 enhance the mechanical strength of both ends of the base 25*a* in the recording medium conveyance direction A1, respectively.

According to this exemplary embodiment, unlike the configurations shown in FIGS. 8 and 9, even if the base 25*a* receives pressure from the pressing roller 22, the base 25*a* is not bent at both ends thereof in the recording medium conveyance direction A1. Additionally, the upstream projection 25*b*1 and the downstream projection 25*b*2 enhance the mechanical strength of the base 25*a* at the center thereof interposed between the upstream projection 25*b*1 and the downstream projection 25*b*2 in the recording medium conveyance direction A1, thus enhancing the mechanical strength of the entire stay 25. As a result, the stay 25 supports the nip formation assembly 24 properly, preventing bending of the nip formation assembly 24.

It is to be noted that the upstream projection 25*b*1 and the downstream projection 25*b*2 project from the base 25*a* at least at portions thereof corresponding to or outboard from the upstream edge N1 and the downstream edge N2 of the fixing nip N, respectively. That is, the upstream projection 25*b*1 and the downstream projection 25*b*2 project from the base 25*a* at both edges of the center thereof where the base 25*a* receives pressure from the pressing roller 22 or at positions outboard from the center of the base 25*a* in the recording medium conveyance direction A1, thus enhancing the mechanical strength of the base 25*a* against pressure from the pressing roller 22. Alternatively, the stay 25 may incorporate three or more projections projecting from the base 25*a* instead of the two projections, that is, the upstream projection 25*b*1 and the downstream projection 25*b*2.

In order to enhance the mechanical strength of the stay 25 further, a front edge 25*c* of each of the upstream projection 25*b*1 and the downstream projection 25*b*2 is disposed as close as possible to the inner circumferential surface of the fixing belt 21. However, since the fixing belt 21 swings or vibrates as it rotates, if the front edge 25*c* of each of the upstream projection 25*b*1 and the downstream projection 25*b*2 is excessively close to the inner circumferential surface of the fixing belt 21, the swinging or vibrating fixing belt 21 may come into contact with the upstream projection 25*b*1 or the downstream projection 25*b*2. For example, if the thin fixing belt 21 is used as in this exemplary embodiment, the thin fixing belt 21 swings or vibrates substantially. Accordingly, it is necessary to position the front edge 25*c* of each of the upstream projection 25*b*1 and the downstream projection 25*b*2 with respect to the fixing belt 21 carefully.

Specifically, as shown in FIG. 7, a distance d between the front edge 25*c* of each of the upstream projection 25*b*1 and the downstream projection 25*b*2 and the inner circumferential surface of the fixing belt 21 in the pressurization direction D1 of the pressing roller 22 is at least about 2.0 mm, preferably not smaller than about 3.0 mm. Conversely, if the fixing belt 21 is thick and therefore barely swings or vibrates, the distance d may be about 0.02 mm. It is to be noted that if the reflector 26 is attached to the front edge 25*c* of each of the upstream projection 25*b*1 and the downstream projection 25*b*2 as in this exemplary embodiment, the distance d is determined by considering the thickness of the reflector 26 so that the reflector 26 does not contact the fixing belt 21.

The front edge 25*c* of each of the upstream projection 25*b*1 and the downstream projection 25*b*2 situated as close as possible to the inner circumferential surface of the fixing belt 21 allows the upstream projection 25*b*1 and the downstream projection 25*b*2 to project longer from the base 25*a* in the pressurization direction D1 of the pressing roller 22. Accordingly, even if the fixing belt 21 has a decreased loop diameter, the stay 25 having the longer upstream projection 25*b*1 and the longer downstream projection 25*b*2 attains an enhanced mechanical strength.

In contrast to the stay 25, the nip formation assembly 24 is compact, thus allowing the stay 25 to extend as long as possible inside the loop formed by the fixing belt 21. For example, the length of the base pad 241 of the nip formation assembly 24 is smaller than that of the stay 25 in the recording medium conveyance direction A1. As shown in FIG. 7, the base pad 241 includes an upstream portion 24*a* disposed upstream from the fixing nip N in the recording medium conveyance direction A1; a downstream portion 24*b* disposed downstream from the fixing nip N in the recording medium conveyance direction A1; and a center portion 24*c* interposed between the upstream portion 24*a* and the downstream portion 24*b* in the recording medium conveyance direction A1. A height h1 defines a height of the upstream portion 24*a* from the fixing nip N or its hypothetical extension E in the pressurization direction D1 of the pressing roller 22. A height h2 defines a height of the downstream portion 24*b* from the fixing nip N or its hypothetical extension E in the pressurization direction D1 of the pressing roller 22. A height h3, that is, a maximum height of the base pad 241, defines a height of the center portion 24*c* from the fixing nip N or its hypothetical extension E in the pressurization direction D1 of the pressing roller 22. The height h3 is not smaller than the height h1 and the height h2.

Hence, the upstream portion 24*a* of the base pad 241 of the nip formation assembly 24 is not interposed between the inner circumferential surface of the fixing belt 21 and an upstream curve 25*d*1 of the stay 25 in a diametrical direction of the fixing belt 21. Similarly, the downstream portion 24*b* of the base pad 241 of the nip formation assembly 24 is not interposed between the inner circumferential surface of the fixing belt 21 and a downstream curve 25*d*2 of the stay 25 in the diametrical direction of the fixing belt 21 and the pressurization direction D1 of the pressing roller 22. Accordingly, the upstream curve 25*d*1 and the downstream curve 25*d*2 of the stay 25 are situated in proximity to the inner circumferential surface of the fixing belt 21. Consequently, the stay 25 having an increased size that enhances the mechanical strength thereof is accommodated in the limited space inside the loop formed by the fixing belt 21.

Although the belt holder 40 serving as a guide that guides the rotating fixing belt 21 is interposed between the stay 25 and the fixing belt 21 at both lateral ends 21*b* of the fixing belt 21 as shown in FIG. 6B, since no guide other than the nip formation assembly 24 is interposed between the stay 25 and the fixing belt 21, the stay 25 is situated in proximity to the inner circumferential surface of the fixing belt 21, thus attaining the enhanced mechanical strength of the stay 25.

As shown in FIG. 7, the halogen heater 23 is interposed between the upstream projection 25*b*1 and the downstream projection 25*b*2 of the stay 25 or between an inner extension L of the upstream projection 25*b*1 and an inner extension L of the downstream projection 25*b*2 of the stay 25. That is, the halogen heater 23 and the stay 25 are compacted inside the loop formed by the fixing belt 21. Further, the halogen heater 23 is situated at a position corresponding to substantially a center of the fixing nip N in the recording medium conveyance direction A1.

Since the halogen heater 23 is partially or entirely housed by the stay 25, the halogen heater 23 radiates light to a predetermined region on the inner circumferential surface of the fixing belt 21. Generally, the temperature of the fixing belt 21 heated by the halogen heater 23 varies in a circumferential direction of the fixing belt 21. For example, the temperature of a section of the fixing belt 21 situated in proximity to the halogen heater 23 is higher than the temperature of a section of the fixing belt 21 spaced apart from the halogen heater 23.

To address this circumstance, according to this exemplary embodiment, the halogen heater 23 is housed by the stay 25 to concentrate light from the halogen heater 23 to the predetermined region on the inner circumferential surface of the fixing belt 21 where substantially an identical interval is provided between the halogen heater 23 and the inner circumferential surface of the fixing belt 21. Thus, variation in temperature of the fixing belt 21 heated by the halogen heater 23 is minimized. Accordingly, the uniformly heated fixing belt 21 fixes the toner image T on the recording medium P, improving quality of the toner image T fixed on the recording medium P.

Figure 10:
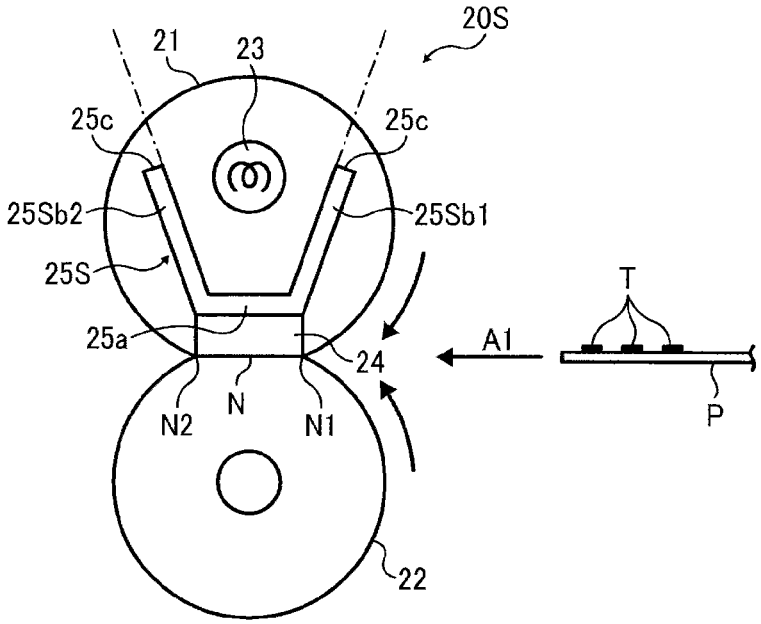
FIG. 10 is a vertical sectional view of a fixing device according to another exemplary embodiment of the present invention.

With reference to FIG. 10, a description is provided of a variation of the stay 25 depicted in FIG. 7.

FIG. 10 is a vertical sectional view of a fixing device 20S incorporating a stay 25S as a variation of the stay 25 depicted in FIG. 7. The stay 25 shown in FIG. 7 includes the upstream projection 25*b*1 and the downstream projection 25*b*2 projecting substantially orthogonally from the base 25*a*. Conversely, as shown in FIG. 10, the stay 25S includes an upstream projection 25Sb1 disposed upstream from the base 25*a* in the recording medium conveyance direction A1 and projecting from the base 25*a* toward the inner circumferential surface of the fixing belt 21 and a downstream projection 25Sb2 disposed downstream from the base 25*a* in the recording medium conveyance direction A1 and projecting from the base 25*a* toward the inner circumferential surface of the fixing belt 21. The upstream projection 25Sb1 and the downstream projection 25Sb2 are tilted with respect to the base 25*a*. Alternatively, the stay 25S may have other shapes.

Figure 11:
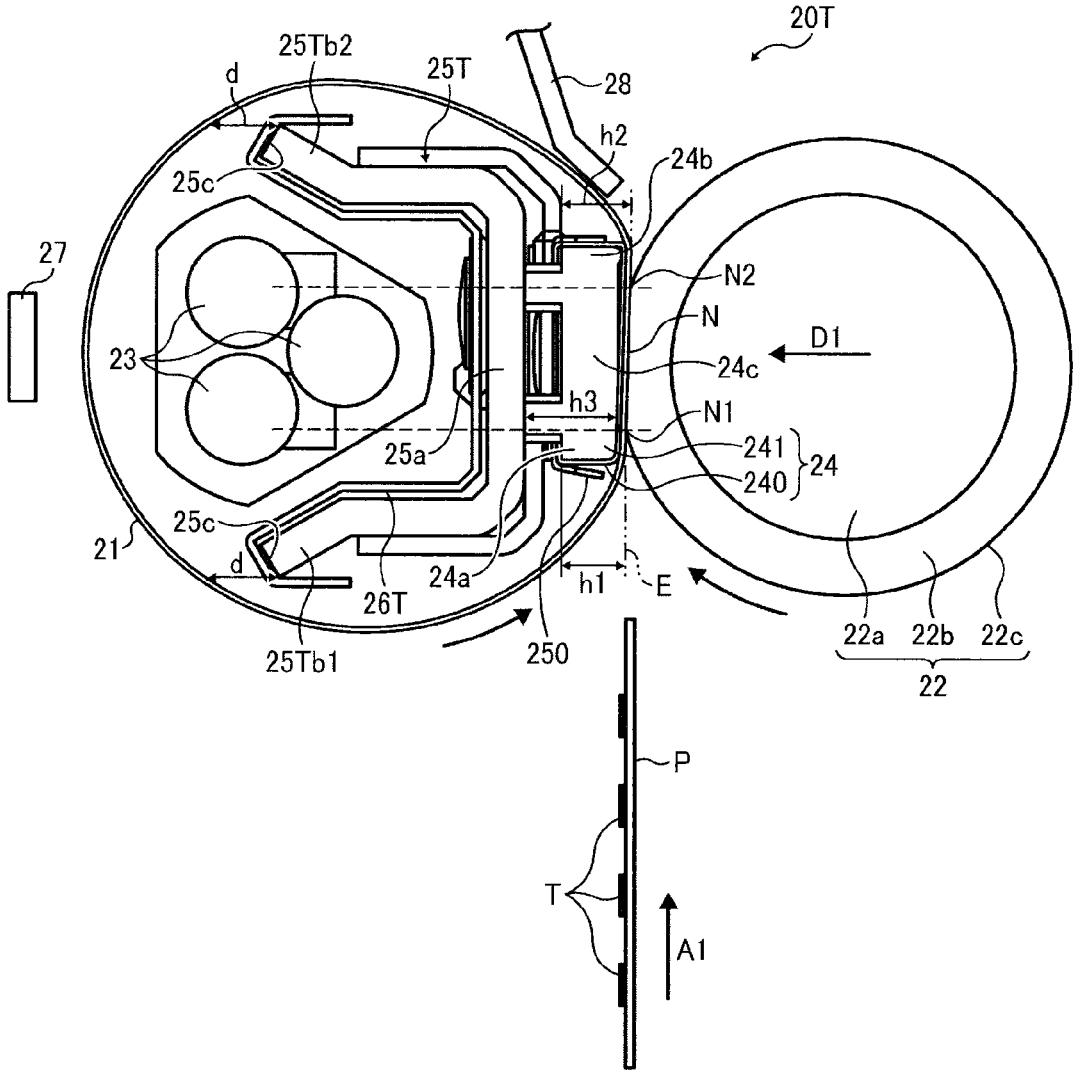
FIG. 11 is a vertical sectional view of a fixing device according to yet another exemplary embodiment of the present invention.

With reference to FIG. 11, a description is provided of a configuration of a fixing device 20T according to another exemplary embodiment.

FIG. 11 is a vertical sectional view of the fixing device 20T. Unlike the fixing device 20 depicted in FIG. 7, the fixing device 20T includes three halogen heaters 23 serving as heaters that heat the fixing belt 21. The three halogen heaters 23 have three different regions thereof in the axial direction of the fixing belt 21 that generate heat. Accordingly, the three halogen heaters 23 heat the fixing belt 21 in three different regions on the fixing belt 21, respectively, in the axial direction thereof so that the fixing belt 21 heats recording media P of various widths in the axial direction of the fixing belt 21. The fixing device 20T further includes a metal plate 250 that partially surrounds the nip formation assembly 24. Thus, a stay 25T supports the nip formation assembly 24 via the metal plate 250.

Instead of the bracket-shaped stay 25 shown in FIG. 7, the fixing device 20T includes the substantially trapezoidal stay 25T that houses the three halogen heaters 23. For example, the stay 25T is constructed of the base 25*a*; an upstream projection 25Tb1 projecting from the base 25*a* and bent downward toward the inner circumferential surface of the fixing belt 21; and a downstream projection 25Tb2 projecting from the base 25*a* and bent upward toward the inner circumferential surface of the fixing belt 21. Instead of the reflector 26 shown in FIG. 7, the fixing device 20T includes a reflector 26T, shaped in accordance with the shape of the stay 25T, mounted on the stay 25T.

Similar to the heights h1, h2, and h3 shown in FIG. 7, the heights h1, h2, and h3 shown in FIG. 11 define the height of the upstream portion 24*a* of the base pad 241, the height of the downstream portion 24*b* of the base pad 241, and the height of the center portion 24*c* of the base pad 241, respectively. In order to increase the size of the stay 25T, the height h3 is not smaller than the height h1 and the height h2.

With reference to FIGS. 7, 10, and 11, a description is provided of advantages of the fixing devices 20, 20S, and 20T.

As shown in FIGS. 7, 10, and 11, the downstream projection (e.g., the downstream projections 25*b*2, 25Sb2, and 25Tb2) is spaced apart from the upstream projection (e.g., the upstream projections 25*b*1, 25Sb1, and 25Tb1). The upstream projection is situated at a position on the base 25*a* corresponding to or upstream from the upstream edge N1 of the fixing nip N in the recording medium conveyance direction A1. The downstream projection is situated at a position on the base 25*a* corresponding to or downstream from the downstream edge N2 of the fixing nip N in the recording medium conveyance direction A1. Accordingly, the upstream projection and the downstream projection enhance the mechanical strength of the base 25*a* against pressure from the pressing roller 22 serving as an opposed rotary body. Consequently, the base 25*a* supports the nip formation assembly 24 properly, preventing the nip formation assembly 24 from being bent by pressure from the pressing roller 22. As a result, the nip formation assembly 24 forms the uniform fixing nip N throughout the axial direction of the pressing roller 22, which achieves uniform application of heat and pressure from the fixing belt 21 and the pressing roller 22 to the recording medium P, resulting in formation of a high quality toner image T on the recording medium P.

For example, it is difficult for the fixing belt 21 having a decreased loop diameter to accommodate a stay having an increased mechanical strength. However, the stay (e.g., the stays 25, 25S, and 25T) according to the exemplary embodiments described above has an increased mechanical strength that achieves the advantages described above.

Additionally, the front edge 25*c* of each of the upstream projection and the downstream projection of the stay is situated as close as possible to the inner circumferential surface of the fixing belt 21, thus enhancing the mechanical strength of the stay.

Since the fixing belt 21 accommodates the compact nip formation assembly 24 and no guide interposed between the stay and the inner circumferential surface of the fixing belt 21, increased space is allocated to the stay inside the loop formed by the fixing belt 21. Accordingly, the stay has an increased size great enough to support the nip formation assembly 24 so as to prevent the nip formation assembly 24 from being bent by pressure from the pressing roller 22.

The present invention is not limited to the details of the exemplary embodiments described above, and various modifications and improvements are possible. For example, as shown in FIG. 3, the image forming apparatus 1 incorporating the fixing device 20, 20S, or 20T is a color laser printer. Alternatively, the image forming apparatus 1 may be a monochrome printer, a copier, a facsimile machine, a multifunction printer (MFP) having at least one of copying, printing, facsimile, and scanning functions, or the like.

According to the exemplary embodiments described above, the pressing roller 22 serves as an opposed rotary body disposed opposite the fixing belt 21. Alternatively, a pressing belt or the like may serve as an opposed rotary body. Further, the halogen heater 23 disposed inside the fixing belt 21 serves as a heater that heats the fixing belt 21. Alternatively, the halogen heater 23 may be disposed outside the fixing belt 21.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt rotatable in a predetermined direction of rotation;

a nip formation assembly disposed opposite an inner circumferential surface of the endless belt;

an opposed rotary body pressed against the nip formation assembly in a pressurization direction via the endless belt to form a fixing nip between the endless belt and the opposed rotary body through which a recording medium bearing a toner image is conveyed; and a support that contacts and supports the nip formation assembly and that does not contact the endless belt, the support including:

a base contacting the nip formation assembly, an upstream projection projecting from the base in the pressurization direction of the opposed rotary body at a position on the base corresponding to or upstream from an upstream edge of the fixing nip in a recording medium conveyance direction, and a downstream projection projecting from the base in the pressurization direction of the opposed rotary body at a position on the base corresponding to or downstream from a downstream edge of the fixing nip in the recording medium conveyance direction, the downstream projection spaced apart from the upstream projection in the recording medium conveyance direction, wherein a length of the base of the support is such that each end of the base extends beyond a corresponding end of the fixing nip and such that the upstream projection and the downstream projection, which project from respective ends of the base, are disposed entirely outside of a fixing nip area that is defined as an area between parallel planes extending orthogonally, through respective ends of the fixing nip, in a direction of extension of the fixing nip.

2. The fixing device according to claim 1, further comprising a belt holder contacting and rotatably supporting each lateral end of the endless belt in an axial direction thereof.

3. The fixing device according to claim 1, wherein the nip formation assembly supports a center of the endless belt in an axial direction thereof.

4. The fixing device according to claim 1, wherein the nip formation assembly includes a base pad pressing against the opposed rotary body via the endless belt to define the fixing nip, the base pad being smaller than the support in the recording medium conveyance direction.

5. The fixing device according to claim 4, wherein the nip formation assembly further includes a low-friction sheet covering the base pad, over which the endless belt slides.

6. The fixing device according to claim 4, wherein the base pad of the nip formation assembly includes:

an upstream portion disposed upstream from the fixing nip in the recording medium conveyance direction and having a first height in the pressurization direction of the opposed rotary body;

a downstream portion disposed downstream from the fixing nip in the recording medium conveyance direction and having a second height in the pressurization direction of the opposed rotary body; and a center portion interposed between the upstream portion and the downstream portion in the recording medium conveyance direction and defining the fixing nip, the center portion having a third height in the pressurization direction of the opposed rotary body, and wherein the third height of the center portion is not smaller than the first height of the upstream portion and the second height of the downstream portion.

7. The fixing device according to claim 1, further comprising a heater disposed on a side of the support opposite the nip formation assembly to heat the endless belt.

8. The fixing device according to claim 7, wherein the heater is situated at a position corresponding to substantially a center of the fixing nip in the recording medium conveyance direction.

9. The fixing device according to claim 7, wherein the heater is interposed between the upstream projection and the downstream projection of the support in the recording medium conveyance direction.

10. The fixing device according to claim 7, further comprising a reflector mounted on the support and reflecting light radiated from the heater toward the inner circumferential surface of the endless belt.

11. The fixing device according to claim 10, wherein a reflection rate of the reflector is not smaller than about 90 percent.

12. The fixing device according to claim 10, wherein the reflector includes a reflection face partially or entirely shaped to reflect light from the heater in directions other than a direction toward the heater.

13. The fixing device according to claim 1, wherein each of the upstream projection and the downstream projection of the support includes a front edge disposed opposite the inner circumferential surface of the endless belt with a distance therebetween in the pressurization direction of the opposed rotary body, the distance being not smaller than about 2.0 mm.

14. The fixing device according to claim 1, wherein the upstream projection and the downstream projection of the support project from the base substantially orthogonally to the base.

15. The fixing device according to claim 1, wherein the upstream projection and the downstream projection of the support are tilted with respect to the base.

16. The fixing device according to claim 1, wherein the upstream projection and the downstream projection of the support are bent into a substantially trapezoidal bracket.

17. The fixing device according to claim 1, wherein the support includes a stay.

18. The fixing device according to claim 1, further comprising a metal plate interposed between the nip formation assembly and the support and partially surrounding the nip formation assembly.

19. The fixing device according to claim 1, wherein the opposed rotary body includes a pressing roller.

20. An image forming apparatus comprising the fixing device according to claim 1.

21. The fixing device according to claim 1, further comprising a reflector disposed opposite the nip formation assembly that reflects light toward the inner circumferential surface of the endless belt.

22. The fixing device according to claim 21, wherein a portion of the reflector extends along an outer face of the upstream projection and the downstream projection of the support.

23. The fixing device according to claim 7, further comprising a reflector interposed between the heater and the support to reflect light radiated from the heater toward the inner circumferential surface of the endless belt, the reflector including a bent portion bent along a downstream outer face of the downstream projection of the support.

24. The fixing device according to claim 23, wherein the bent portion of the reflector is smaller than the downstream projection of the support in the pressurization direction of the opposed rotary body.

* * * * *